US008182622B1

(12) United States Patent
Ouart et al.

(10) Patent No.: US 8,182,622 B1
(45) Date of Patent: May 22, 2012

(54) NO-PERCHLORATE FLARE COMPOSITION

(75) Inventors: David Charles Ouart, Easton, MD (US); John Alexander Conkling, Chestertown, MD (US); Jeffrey Woodrow Johnson, Chestertown, MD (US)

(73) Assignee: Standard Fusee Corporation, Easton, MD (US)

( * ) Notice: Subject to any disclaimer, the term of this patent is extended or adjusted under 35 U.S.C. 154(b) by 0 days.

(21) Appl. No.: 13/047,340

(22) Filed: Mar. 14, 2011

(51) Int. Cl.

| | |
|---|---|
| ***C06B 31/00*** | (2006.01) |
| ***C06B 31/02*** | (2006.01) |
| ***D03D 23/00*** | (2006.01) |
| ***D03D 43/00*** | (2006.01) |

(52) U.S. Cl. ..... 149/45; 149/61; 149/109.2; 149/109.4; 149/109.6

(58) Field of Classification Search ..... 149/45, 149/61, 109.2, 109.4, 109.6
See application file for complete search history.

(56) References Cited

U.S. PATENT DOCUMENTS

| | | | | |
|---|---|---|---|---|
| 3,257,801 | A * | 6/1966 | Martinez et al. | 60/219 |
| 3,841,929 | A * | 10/1974 | Craig | 149/17 |
| 3,862,865 | A * | 1/1975 | McManus et al. | 149/19.91 |
| 4,078,954 | A * | 3/1978 | Bernardy | 149/19.8 |
| 6,599,379 | B2 * | 7/2003 | Hiskey et al. | 149/19.8 |

* cited by examiner

*Primary Examiner* — James McDonough
(74) *Attorney, Agent, or Firm* — Barbara A. Wrigley; Oppenheimer Wolff & Donnelly, LLP

(57) ABSTRACT

The invention provides for a perchlorate-free pyrotechnic composition. In one embodiment of the present invention, the pyrotechnic composition includes from approximately sixty-seven percent (67%) to approximately seventy-eight percent (78%) of strontium nitrate [$Sr(NO_3)_2$], from approximately two percent (2%) to approximately eleven percent (11%) of potassium nitrate [$KNO_3$], from approximately six percent (6%) to approximately fifteen percent (15%) of sulfur [S], from approximately one percent (1%) to approximately ten percent (10%) of polyvinyl chloride, from approximately one percent (1.0%) to approximately four percent (4%) of paraffin oil, and from approximately zero percent (0%) to approximately two percent (2%) of sawdust mixture.

8 Claims, 3 Drawing Sheets

NO-PERCHLORATE FLARE COMPOSITION

BACKGROUND OF THE INVENTION

1. Field of the Invention

The present invention relates to illuminating pyrotechnic compositions, such as those in signal or distress flares, and to signal flares and the like comprising such compositions. More specifically, the invention relates to flare compositions denoting the absence of perchlorate oxidizers from such compositions, and signal or distress flares having compositions denoting the absence of perchlorate oxidizers.

2. Background of the Invention

Pyrotechnics are used in a variety of applications including signal or distress flares. Most existing flares use perchlorate oxidizers to produce their desired colors, but there are a variety of shortcomings with such perchlorate oxidizers. For example, residual perchlorates may leach into groundwater and require remediation. Perchlorates cause widespread contamination in groundwater, which has been found to be a serious problem. When perchlorates are present in drinking water they can inhibit the uptake of iodine by the thyroid gland, leading to potentially serious health problems that can result in permanent neurological damage.

Attempts have been made to reformulate pyrotechnic compositions to eliminate perchlorate ingredients, while maintaining acceptable performance levels of the flares. However, such attempts result in the use of less energetic oxidizers or other factors that reduce the efficacy of the flare. In one exemplary reformulation, perchlorate oxidizers are substituted with nitrate or other less energetic oxidizers. Because these oxidizers are less reactive than those that include perchlorate, high-energy metal fuels are used to make up for the loss in energy. As appreciated by those skilled in the art, metal fuels are hazardous to the environment and degrade over time. Furthermore, the risk of ignition of the metal fuels makes manufacturing of the pyrotechnic composition a sensitive process.

The present invention, inter alia, provides for reformulated pyrotechnic compositions that eliminate perchlorate ingredients while still maintaining acceptable flare performance without the use of metal fuels or highly energetic materials, such as those categorized as UN (United Nations) 1.1 materials.

BRIEF SUMMARY OF THE INVENTION

The invention provides for a perchlorate-free pyrotechnic composition. In one embodiment of the present invention, the pyrotechnic composition includes from approximately sixty-seven percent (67%) to approximately seventy-eight percent (78%) of strontium nitrate [$Sr(NO_3)_2$], from approximately two percent (2%) to approximately eleven percent (11%) of potassium nitrate [$KNO_3$], from approximately six percent (6%) to approximately fifteen percent (15%) of sulfur [S], from approximately one percent (1%) to approximately ten percent (10%) of polyvinyl chloride, from approximately one percent (1.0%) to approximately four percent (4%) of paraffin oil, and from approximately zero percent (0%) to approximately two percent (2%) of sawdust mixture.

DETAILED DESCRIPTION OF THE INVENTION

Figure 1:
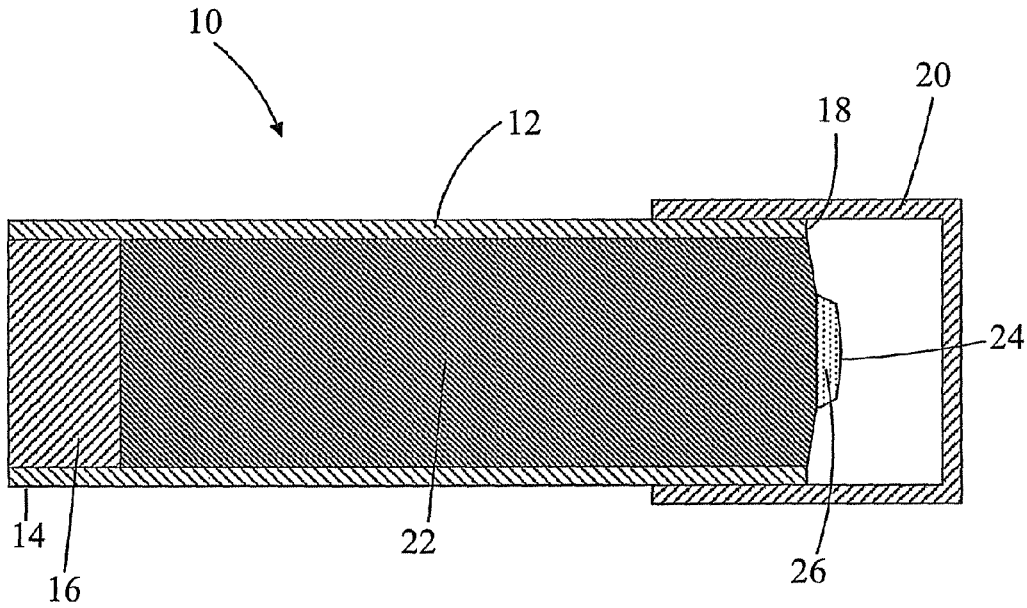
FIG. 1 is a longitudinal sectional view of one embodiment of the present invention.

The embodiments disclosed herein are not exhaustive nor do they limit the invention to the precise forms disclosed in the following detailed description. Referring now to FIG. 1, a flare 10 comprising a pyrotechnic composition 22 is shown. More specifically, the flare 10 may comprise a cylindrical paper tube or casing 12 closed at its rearward end 14 by a plug 16 which may be made of wood or plastic or the like. The plug 16 seals the rearward end 14 of the flare 10 to form a closure. At the forward end 18 of the flare 10, opposite the rearward end 14, a fitted cap 20 is mounted so as to form another closure, thereby enclosing the composition 22. An ignition button composition 26 may be affixed or set into the forwardmost tip 24 of the pyrotechnic composition 22, or proximate the forwardmost tip 24 of the pyrotechnic composition 22, in an arrangement such that lighting the ignition button composition 26 ignites the pyrotechnic composition 22.

In the present disclosure, perchlorate oxidizers currently used in various flare compositions are substituted. The perchlorate-free pyrotechnic composition 22 may include from approximately sixty-seven percent (67%) to approximately seventy-eight percent (78%) of strontium nitrate [$Sr(NO_3)_2$], from approximately two percent (2%) to approximately eleven percent (11%) of potassium nitrate [$KNO_3$], from approximately six percent (6%) to approximately fifteen percent (15%) of sulfur [S], from approximately one percent (1%) to approximately ten percent (10%) of polyvinyl chloride, from approximately one percent (1.0%) to approximately four percent (4%) of paraffin oil, and from approximately zero percent (0%) to approximately two percent (2%) of sawdust mixture.

In one specific embodiment, the pyrotechnic composition 22 of the present disclosure includes:

| Ingredient | % By Mass |
|---|---|
| Strontium Nitrate | 72.40% |
| Potassium Nitrate | 8.05% |
| Sulfur | 10.45% |
| Polyvinyl Chloride | 5.34% |
| Paraffin Oil | 2.82% |
| Sawdust Mixture | 0.94% |

As set forth above, the sawdust mixture may be omitted from the perchlorate-free pyrotechnic composition 22 (i.e. a composition that includes 0% sawdust mixture). However, when the sawdust mixture is present in the perchlorate-free pyrotechnic composition 22, numerous mixtures are possible as will be appreciated by those skilled in the art. For example, in one exemplary embodiment the sawdust mixture may comprise a combination of hardwood sawdust, paraffin oil, and paraffin wax. Particularly, the sawdust mixture may include from approximately seventy-four percent (74%) to approximately eighty-four percent (84%) of hardwood sawdust, from approximately seven percent (7%) to approximately eighteen percent (18%) of paraffin wax, and from approximately zero percent (0%) to approximately thirteen percent (13%) of paraffin oil.

In view of the foregoing, the perchlorate-free pyrotechnic composition of the present invention is not limited to a particular sawdust mixture, or even the presence of a sawdust mixture in the composition at all.

In one specific embodiment, the sawdust mixture includes:

| Sawdust Mixture | % By Mass |
|---|---|
| Hardwood Sawdust | 78.8% |
| Paraffin Wax | 13.2% |
| Paraffin Oil | 8.0% |

In addition to providing an appropriate concentration of the various ingredients in the pyrotechnic composition 22, the particle size distribution of the various ingredients may also be an important factor in the successful creation of a no-perchlorate flare. For example, one exemplary embodiment of the pyrotechnic composition 22 may include the following particle size distributions:

| Ingredient | Particle Size Distribution |
|---|---|
| Strontium Nitrate | i. 2% +/− 2% of total mass retained on 20 mesh screen |
| | ii. 2% +/− 2% of total mass retained on 30 mesh screen |
| | iii. 27% +/− 10% of total mass retained on 40 mesh screen |
| | iv. 33% +/− 10% of total mass retained on 50 mesh screen |
| | v. 21% +/− 10% of total mass retained on 70 mesh screen |
| | vi. 7% +/− 5% of total mass retained on 100 mesh screen |
| | vii. 5% +/− 4% of total mass retained on 140 mesh screen |
| | viii. 4% +/− 4% of total mass to pan |
| Potassium Nitrate | i. 4% +/− 3% of total mass retained on 40 mesh screen |
| | ii. 64% +/− 24% of total mass retained on 100 mesh screen |
| | iii. 16% +/− 8% of total mass retained on 140 mesh screen |
| | iv. 9% +/− 7% of total mass retained on 200 mesh screen |
| | v. 7% +/− 6% of total mass retained in pan |
| Sulfur | i. 20% of total mass retained on 200 mesh screen |
| Polyvinyl Chloride | i. Median particle size of 5 microns to 100 microns |
| Paraffin Oil | N/A |
| Hardwood Sawdust Component of Sawdust Mixture | i. Maximum 3% of total mass retained on 10 mesh screen |
| | ii. Minimum 85% of total mass retained on 30 mesh screen |
| | iii. Maximum 10% of total mass retained on 60 mesh screen |
| | iv. Maximum 6% of total mass to pan |

In one exemplary but non-limiting embodiment, the polyvinyl chloride ingredient may be defined by numerous properties including a degree of polymerization between approximately 800 and approximately 3000, a gel temperature (FF, ALTC-29) between approximately 140° F. and approximately 250° F., a K-value between approximately 60 and approximately 120, and a relative viscosity (1% cyclohexanone) between approximately 2 and approximately 4. However, polyvinyl chloride ingredients defined by various other properties or property values are also possible.

The paraffin wax ingredient of the sawdust mixture may have a melting point between approximately 100° F. and approximately 140° F., an oil content between approximately 0.5% and approximately 3.5%, a viscosity at 210° F. between approximately 30 and approximately 55, and a flash point greater than approximately 380° F. However, paraffin wax ingredients defined by various other properties or property values are also possible. The paraffin oil ingredient of the sawdust mixture may have a boiling point between approximately 650° F. and approximately 1300° F., although other boiling points are also possible.

As will be appreciated by those skilled in the art, numerous alternative embodiments of the pyrotechnic composition 22 are possible and within the scope of the present invention. For example, in alternative embodiments the potassium nitrate ingredient may be replaced with another suitable nitrate compound including, but not limited to, calcium nitrate, lithium nitrate, or magnesium nitrate. The polyvinyl chloride ingredient may also be replaced with one or more alternative chlorinated ingredients, such as a chlorinated paraffin wax or a chlorinated rubber.

Additionally, the paraffin oil (in both the sawdust mixture and the pyrotechnic composition generally) may be replaced with one or more alternative ingredients including, but not limited to, naphthenic oil, castor oil, halogenated hydrocarbon liquid, any of the cooking oils, or various fuel oils such as diesel fuel. Furthermore, the paraffin wax of the sawdust mixture may be replaced with another suitable ingredient such as asphalt, gilsonite, or a halogenated hydrocarbon wax or rubber. For example, in one exemplary alternative embodiment the paraffin wax may be replaced with a chlorinated hydrocarbon.

In view of the non-exhaustive list of substitute ingredients set forth above, one of ordinary skill in the art would realize that many alternative compositions may be formulated without departing from the intended scope of the present invention.

In those embodiments of the present invention that include an ignition button composition 26, the ignition button composition 26 may include from approximately forty percent (40%) to approximately fifty-six percent (56%) of potassium chlorate [KClO3], from approximately twelve percent (12%) to approximately thirty-six percent (36%) of potassium nitrate [$KNO_3$], from approximately four percent (4%) to approximately twelve percent (12%) of strontium nitrate [$Sr(NO_3)_2$], from approximately zero percent (0%) to approximately five percent (5%) of charcoal, from approximately zero percent (0%) to approximately five percent (5%) of marble dust, from approximately zero percent (0%) to approximately five percent (5%) of burnt umber, and from approximately eight percent (8%) to approximately twenty percent (20%) of shellac.

In one specific embodiment, the ignition button composition 26 of the present disclosure includes:

| Ingredient | % By Mass |
|---|---|
| Potassium Chlorate | 48.00% |
| Potassium Nitrate | 24.45% |
| Strontium Nitrate | 7.71% |
| Charcoal | 1.64% |
| Marble Dust | 3.60% |
| Burnt Umber | 2.50% |
| Shellac | 12.10% |

It may be preferable to divide the total potassium chlorate concentration into two portions, including a fine potassium chlorate portion and a coarse potassium chlorate portion. The potassium chlorate component may include from approximately twenty percent (20%) to approximately thirty-six percent (36%) of fine potassium chlorate, and from approximately twelve percent (12%) to approximately twenty-eight percent (28%) of coarse potassium chlorate. With reference to the specific embodiment of the ignition button composition set forth above, the 48% (by mass) of potassium chlorate may be comprised of approximately 28% fine potassium chlorate and approximately 20% coarse potassium chlorate.

In addition to providing an appropriate concentration of the various ingredients in the ignition button composition 26, the particle size distribution of the various ingredients may also be an important factor for the successful manufacture of a no-perchlorate flare. In one exemplary but non-limiting embodiment, the ignition button composition 26 may include the following particle size distribution:

| Ingredient | Particle Size Distribution |
|---|---|
| Fine Potassium Chlorate | i. 32% +/− 10% of total mass less than 212 microns and greater than 125 microns |
| | ii. 11% +/− 10% of total mass less than 125 microns and greater than 106 microns |
| | iii. 19% +/− 10% of total mass less than 106 microns and greater than 75 microns |
| | iv. 7%, +10%/−5%, of total mass less than 75 microns and greater than 63 microns |
| | v. 32% +/− 5% of total mass less than 63 microns |
| Coarse Potassium Chlorate | i. 1% +/− 1% of total mass greater than 180 microns |
| | ii. 31% +/− 10% of total mass less than 180 microns and greater than 75 microns |
| | iii. 25% +/− 10% of total mass less than 75 microns and greater than 45 microns |
| | iv. 44% +/−5% of total mass less than 45 microns |
| Potassium Nitrate | i. 1% of total mass retained on 170 mesh screen |
| Strontium Nitrate | i. 2% +/− 2% of total mass retained on 20 mesh screen |
| | ii. 2% +/− 2% of total mass retained on 30 mesh screen |
| | iii. 27% +/− 10% of total mass retained on 40 mesh screen |
| | iv. 33% +/− 10% of total mass retained on 50 mesh screen |
| | v. 21% +/− 10% of total mass retained on 70 mesh screen |
| | vi. 7% +/− 5% of total mass retained on 100 mesh screen |
| | vii. 5% +/− 4% of total mass retained on 140 mesh screen |
| | viii. 4% +/− 4% of total mass to pan |
| Charcoal | i. Maximum 2% of total mass retained on 100 mesh screen |
| | ii. Minimum 30% of total mass passed through 325 mesh screen |
| Marble Dust | i. Maximum 1% of total mass retained on 325 mesh screen |
| Burnt Umber | i. Maximum 1.0% of total mass retained on 325 mesh screen |
| Shellac | N/A |

Optionally, the potassium nitrate may also include an anti-cake ingredient with a maximum concentration of approximately 1%. Although any suitable anti-cake ingredient may be used, one exemplary anti-cake ingredient that has been found to provide beneficial results is fumed silica.

As will be appreciated by those skilled in the art, numerous alternative embodiments of the ignition button composition 26 are possible and within the scope of the present invention. For example, similar to the pyrotechnic composition 22, the potassium nitrate in the ignition button composition 26 may also be replaced with another suitable nitrate compound such as calcium nitrate, lithium nitrate, magnesium nitrate, or the like. The strontium nitrate in the ignition button composition 26 may also be replaced with alternative nitrate compounds such as calcium nitrate, lithium nitrate, magnesium nitrate, or the like.

The charcoal, marble dust, burnt umber, and shellac ingredients also have suitable substitutes. Substitute compounds for the charcoal ingredient include, but are not limited to, carbon black, aluminum, magnesium, and magnalium. Substitute compounds for the marble dust ingredient include, but are not limited to, technical or reagent grade calcium carbonate, technical or reagent grade strontium carbonate, technical or reagent grade magnesium carbonate, technical or reagent grade lithium carbonate, and technical or reagent grade lithium bicarbonate. Substitute compounds for the burnt umber ingredient include, but are not limited to, technical or reagent grade iron III oxide, technical or reagent grade nickel oxide, technical or reagent grade manganese oxide, and technical or reagent grade black iron oxide. Finally, substitute compounds for the shellac ingredient include, but are not limited to, red gum, gum copal, and colophony resin.

In view of the non-exhaustive list of substitute ingredients set forth above, one of ordinary skill in the art would realize that many alternative compositions may be formulated without departing from the intended scope of the present invention.

Now that the various ingredients and particle size distributions defining the pyrotechnic and ignition button compositions in accordance with the present invention have been described, exemplary mixing sequences for creating the pyrotechnic and ignition button compositions will be set forth in detail.

Figure 2:
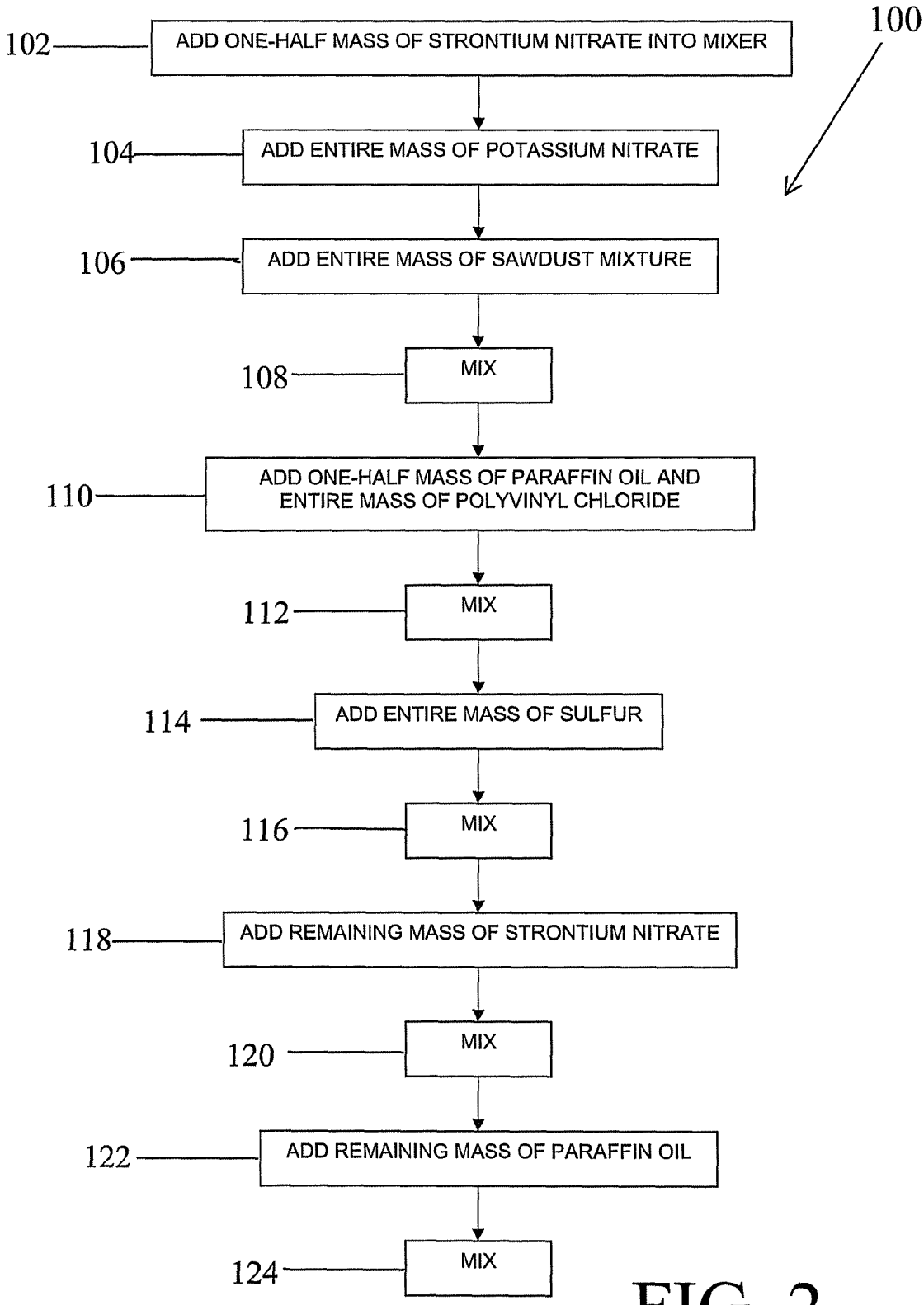
FIG. 2 is a flowchart diagram illustrating one exemplary mixing sequence for forming a pyrotechnic composition in accordance with the present invention

FIG. 2 is a flowchart diagram illustrating one exemplary mixing sequence 100 for forming a pyrotechnic composition for a no-perchlorate flare in accordance with the present invention. Particularly, the mixing sequence 100 will be described with reference to the pyrotechnic composition ingredients set forth in the tables above. However, it should be understood that mixing sequences involving other ingredients are also contemplated and within the intended scope of the present invention.

The mixing sequence 100 begins at step 102 where approximately one-half of the mass of strontium nitrate is added into a mixer. The entire mass of the potassium nitrate is then added to the mixer in step 104, followed by the entire mass of the sawdust mixture in step 106. The combined strontium nitrate, potassium nitrate, and sawdust mixture are subsequently mixed together in step 108.

Moving next to step 110, approximately one-half of the mass of paraffin oil and the entire mass of the polyvinyl chloride is added into the mixer. Preferably, the polyvinyl chloride should not be screened. The combined strontium nitrate, potassium nitrate, sawdust mixture, paraffin oil, and polyvinyl chloride are then mixed together in step 112.

The mixing sequence 100 continues at step 114 where the entire mass of sulfur is added to the mixer, and the ingredients mixed in step 116. After mixing in the entire mass of sulfur, the remaining mass of strontium nitrate is added in step 118, and the ingredients once again mixed in step 120. The mixing sequence 100 ends with the addition of the remaining paraffin oil in step 122, and a final mixing step 124.

Although several exemplary steps were described with reference to the pyrotechnic composition mixing sequence 100, those skilled in the art will appreciate that the order and number of steps may be modified without departing from the intended scope of the invention. Thus, the exemplary steps were provided merely for purposes of example and not limitation.

Figure 3:
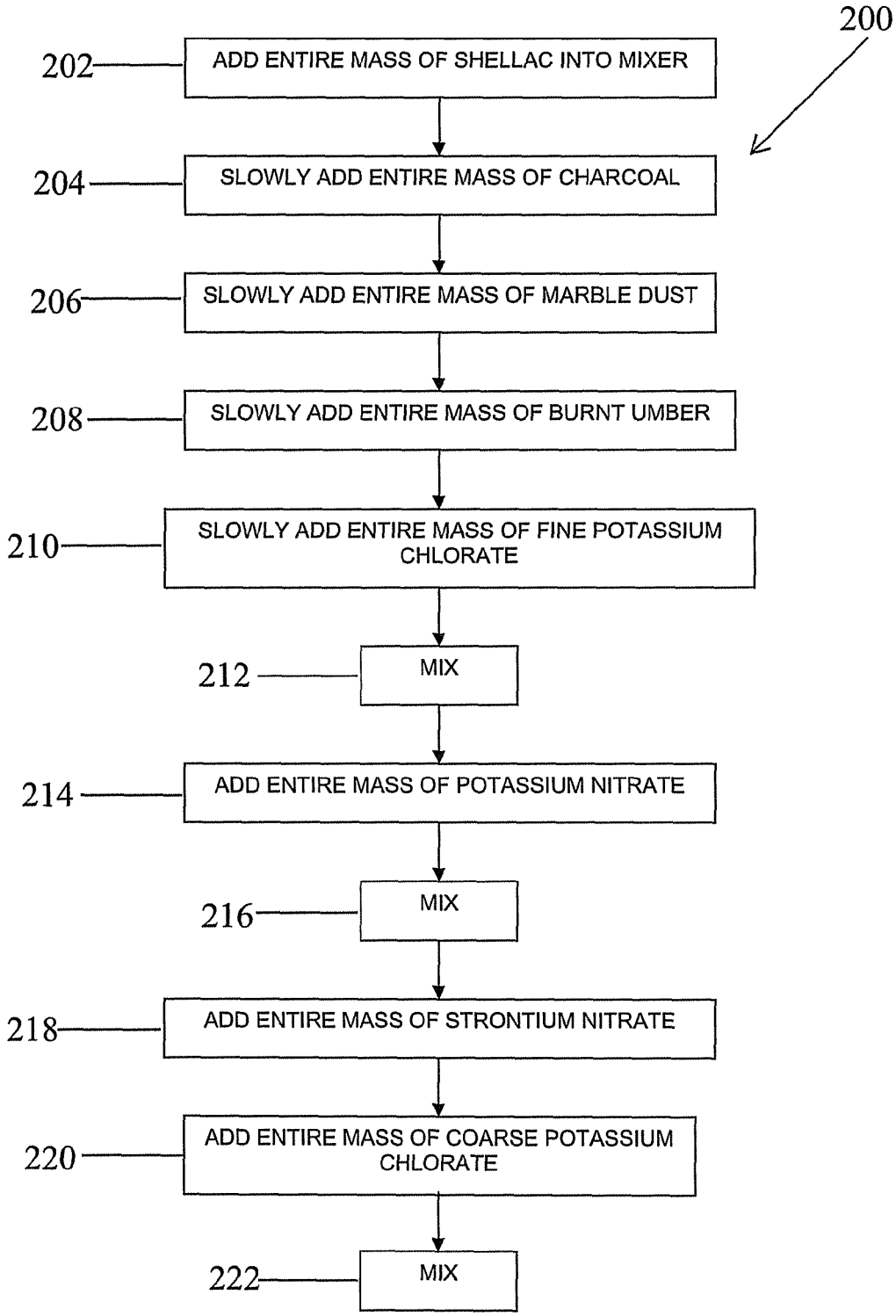
FIG. 3 is a flowchart diagram illustrating one exemplary mixing sequence for forming an ignition button composition in accordance with the present invention.

FIG. 3 is a flowchart diagram illustrating one exemplary mixing sequence 200 for forming an ignition button composition for a no-perchlorate flare in accordance with the present invention. Particularly, the mixing sequence 200 will be described with reference to the ignition button composition ingredients set forth in the tables above. However, it should be understood that mixing sequences involving other ingredients are also contemplated and within the intended scope of the present invention.

The mixing sequence 200 begins at step 202 where the entire mass of the shellac (which has been dissolved in a solvent) is added into a mixer. The entire mass of the charcoal is then slowly added into the mixer in step 204, followed by the marble dust in step 206. After slowly adding the marble dust into the mixer, the burnt umber is slowly added into the mixer in step 208 and the fine potassium chlorate slowly added into the mixer in step 210. The ingredients added into the mixer in steps 202-210 are then mixed together in step 212.

After the initial mixing step 212, the entire mass of the potassium nitrate is added in step 214 followed by another mixing step 216. Subsequently, the entire masses of the strontium nitrate and the coarse potassium chlorate are added into the mixer in steps 218 and 220, respectively. A final mixing step 222 ensures adequate mixing of all of the ingredients.

Although several exemplary steps were described with reference to the ignition button composition mixing sequence 200, those skilled in the art will appreciate that the order and number of steps may be modified without departing from the intended scope of the invention. Thus, the exemplary steps were provided merely for purposes of example and not limitation.

Although various representative embodiments of this invention have been described above with a certain degree of particularity, those skilled in the art could make numerous alterations to the disclosed embodiments without departing from the spirit or scope of the inventive subject matter set forth in the specification and claims.

What is claimed is:

1. A pyrotechnic composition comprising, by mass:

strontium nitrate within the range of approximately sixty-seven percent (67%) to approximately seventy-eight percent (78%) of the composition;

potassium nitrate within the range of approximately two percent (2%) to approximately eleven percent (11%) of the composition;

sulfur within the range of approximately six percent (6%) to approximately fifteen percent (15%) of the composition;

polyvinyl chloride within the range of approximately one percent (1%) to approximately ten percent (10%) of the composition;

paraffin oil within the range of approximately one percent (1.0%) to approximately four percent (4%) of the composition; and a sawdust mixture within the range of approximately zero percent (0%) to approximately two percent (2%) of the composition.

2. The pyrotechnic composition according to claim 1 which is substantially free of perchlorate oxidizers.

3. The pyrotechnic composition according to claim 1, said pyrotechnic composition comprising, by mass, 72.40% of the composition strontium nitrate, 8.05% of the composition potassium nitrate, 10.45% of the composition sulfur, 5.34% of the composition polyvinyl chloride, 2.82% of the composition paraffin oil, and 0.94% of the composition sawdust mixture.

4. The pyrotechnic composition of claim 1 wherein said composition is incorporated into a pyrotechnic flare comprising:

a casing closed at least at one end and containing said pyrotechnic composition.

5. The pyrotechnic flare according to claim 4, said pyrotechnic flare further comprising an ignition button composition, the ignition button composition comprising, by mass:

potassium chlorate within the range of approximately forty percent (40%) to approximately fifty-six percent (56%);

potassium nitrate within the range of approximately twelve percent (12%) to approximately thirty-six percent (36%);

strontium nitrate within the range of approximately four percent (4%) to approximately twelve percent (12%);

charcoal within the range of approximately zero percent (0%) to approximately five percent (5%);

marble dust within the range of approximately zero percent (0%) to approximately five percent (5%);

burnt umber within the range of approximately zero percent (0%) to approximately five percent (5%); and shellac within the range of approximately eight percent (8%) to approximately twenty percent (20%).

6. The pyrotechnic flare according to claim 5, said ignition button composition comprising, by mass, 48.00% of the ignition button composition potassium chlorate; 24.45% of the ignition button composition potassium nitrate; 7.71% of the ignition button composition strontium nitrate; 1.64% of the ignition button composition charcoal; 3.60% of the ignition button composition marble dust; 2.50% of the ignition button composition burnt umber; and 12.10% of the ignition button composition shellac.

7. A method of producing the pyrotechnic composition of claim 1 comprising:

mixing the composition of claim 1 together; and pressing the composition into a casing.

8. The method of producing a pyrotechnic composition according to claim 7, wherein mixing comprises mixing, by mass, 72.40% strontium nitrate, 8.05% potassium nitrate, 10.45% sulfur, 5.34% polyvinyl chloride, 2.82% paraffin oil, and 0.94% sawdust mixture.

* * * * *